US007441534B2

(12) United States Patent
Bastian

(10) Patent No.: US 7,441,534 B2
(45) Date of Patent: Oct. 28, 2008

(54) ROTARY ENGINE SYSTEM

(76) Inventor: Douglas Bastian, P.O. Box 161, North Rose, NY (US) 14516

( * ) Notice: Subject to any disclaimer, the term of this patent is extended or adjusted under 35 U.S.C. 154(b) by 0 days.

(21) Appl. No.: 10/543,744

(22) PCT Filed: Jun. 9, 2004

(86) PCT No.: PCT/US2004/018265

§ 371 (c)(1),
(2), (4) Date: Jul. 29, 2005

(87) PCT Pub. No.: WO2005/001254

PCT Pub. Date: Jan. 6, 2005

(65) Prior Publication Data

US 2006/0124102 A1 Jun. 15, 2006

Related U.S. Application Data

(60) Provisional application No. 60/476,975, filed on Jun. 9, 2003.

(51) Int. Cl.

| | |
|---|---|
| ***F02B 53/00*** | (2006.01) |
| ***F01C 1/02*** | (2006.01) |
| ***F01C 1/063*** | (2006.01) |
| ***F01C 1/06*** | (2006.01) |
| ***F04C 2/063*** | (2006.01) |

(52) U.S. Cl. ..... 123/245; 123/241; 123/246; 123/243; 418/34; 418/35; 418/36

(58) Field of Classification Search ..... 123/245, 123/241, 243, 246; 418/34–38; *F02B 53/00; F01C 1/02, F01C 1/063, 1/06; F04C 2/063*
See application file for complete search history.

(56) References Cited

U.S. PATENT DOCUMENTS

| | | | | |
|---|---|---|---|---|
| 901,554 | A | 10/1908 | Pearson | |
| 912,332 | A | 2/1909 | Thompson | |
| 930,601 | A | 8/1909 | Kasparek | 123/201 |

(Continued)

FOREIGN PATENT DOCUMENTS

| | | | | |
|---|---|---|---|---|
| FR | 540052 | * | 7/1922 | |
| GB | 313413 | * | 10/1930 | |
| JP | 57168022 A | * | 10/1982 | 123/242 |
| JP | 62058020 A | * | 3/1987 | |
| JP | 06002559 A | * | 1/1994 | |
| WO | WO 0181729 A1 | * | 11/2001 | |
| WO | WO 2005047655 A1 | * | 5/2005 | |

OTHER PUBLICATIONS

A translation copy of the reference to Akimoto (Patent Number JP 06-002559 A).*

*Primary Examiner*—Thai-Ba Trieu
(74) *Attorney, Agent, or Firm*—Steven R. Scott

(57) ABSTRACT

This rotary internal combustion engine has two rotatable vane type pistons mounted for axial rotation in a sealed casing. In an exemplary cycle, one piston is released to rotate at or prior to initiating combustion in the combustion space between the two pistons, while the other remains fixed. As the free piston rotates around to the position where the fixed piston is located, it drives exhaust from a prior cycle out of an exhaust outlet and then compresses air towards the combustion space. The roles of the pistons are reversed on the next cycle. Two units may be operated in tandem so that the power stroke of one unit provides power to help finalize the cycle of the other. Hydrogen is used as a preferred fuel, and water preferably serves as a lubricant.

4 Claims, 15 Drawing Sheets

U.S. PATENT DOCUMENTS

Figure 1A:
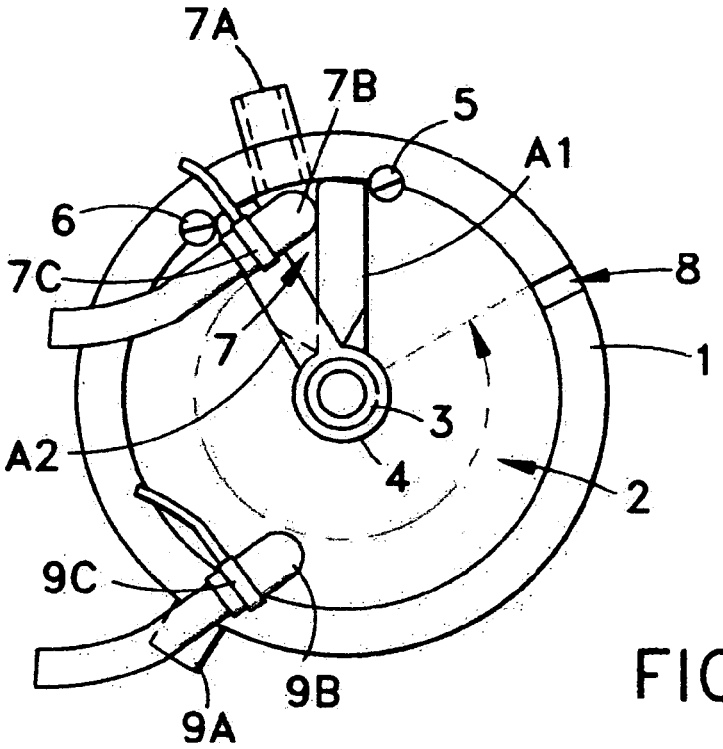

| | | | | | |
|---|---|---|---|---|---|
| 947,403 | A | | 1/1910 | Jagersberger et al. | 123/213 |
| 988,319 | A | | 4/1911 | Edqvist | 123/245 |
| 1,305,966 | A | | 6/1919 | Green | |
| 1,458,641 | A | | 6/1923 | Cizek | 418/34 |
| 1,482,627 | A | | 2/1924 | Bullington | |
| 1,568,053 | A | | 1/1926 | Bullington | |
| 1,652,172 | A | | 12/1927 | King | 271/230 |
| 1,839,275 | A | | 1/1932 | Sweningson | |
| 2,173,663 | A | | 9/1939 | Raymond | |
| 2,367,676 | A | | 1/1945 | Griffith | |
| 2,816,527 | A | | 12/1957 | Palazzo | 418/36 |
| 2,944,533 | A | | 7/1960 | Park | |
| 3,227,090 | A | | 1/1966 | Bartolozzi | 418/35 |
| 3,256,866 | A | | 6/1966 | Bauer | |
| 3,270,719 | A | | 9/1966 | Hamada | |
| 3,340,815 | A | * | 9/1967 | Sinnott | 418/35 |
| 3,359,956 | A | | 12/1967 | Bentele | |
| 3,595,014 | A | | 7/1971 | McMaster | |
| 3,712,273 | A | | 1/1973 | Thomas | 123/248 |
| 3,769,946 | A | * | 11/1973 | Scherrer | 418/36 |
| 3,857,370 | A | | 12/1974 | Hemenway | |
| 3,858,560 | A | * | 1/1975 | Harrington | 418/36 |
| 3,885,532 | A | | 5/1975 | Pike | |
| 3,918,258 | A | | 11/1975 | Gaschler | |
| 3,918,414 | A | | 11/1975 | Hughes | |
| 4,034,718 | A | | 7/1977 | Snider | |
| 4,136,661 | A | | 1/1979 | Posson | |
| 4,148,292 | A | | 4/1979 | Reytblatt | 123/245 |
| 4,194,871 | A | * | 3/1980 | Studenroth | 418/38 |
| 4,239,465 | A | | 12/1980 | Guillaume | |
| 4,279,577 | A | | 7/1981 | Appleton | |
| 4,319,551 | A | | 3/1982 | Rubinshtein | 123/245 |
| 4,604,909 | A | | 8/1986 | Marson | |
| 4,605,361 | A | * | 8/1986 | Cordray | 418/38 |
| 4,646,694 | A | | 3/1987 | Fawcett | |
| 4,776,777 | A | * | 10/1988 | Doty | 418/61.1 |
| 4,890,591 | A | | 1/1990 | Stauffer | |
| 5,192,201 | A | | 3/1993 | Beben | |
| 5,429,085 | A | | 7/1995 | Stauffer | 123/245 |
| 5,501,070 | A | * | 3/1996 | Lin | 418/34 |
| 5,685,269 | A | | 11/1997 | Wittry | 123/245 |
| 6,962,137 | B2 | * | 11/2005 | Udy | 123/245 |
| 2003/0121494 | A1 | * | 7/2003 | Yosikane | 123/243 |
| 2005/0013719 | A1 | * | 1/2005 | Fong et al. | 418/36 |

* cited by examiner

FIG 4A
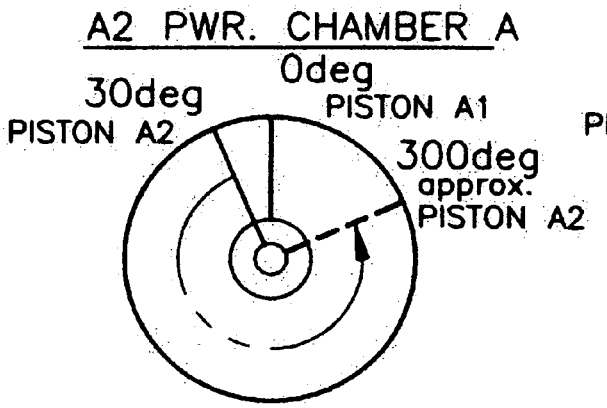
FIG. 5A
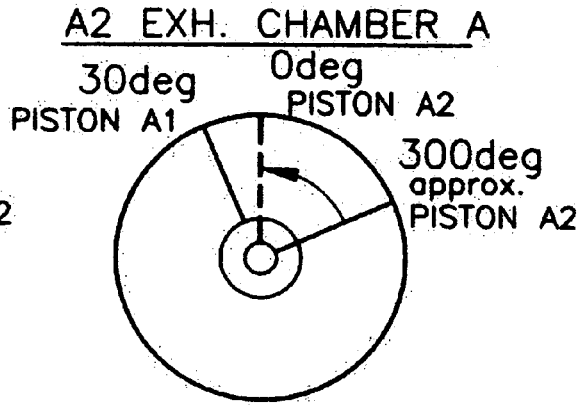
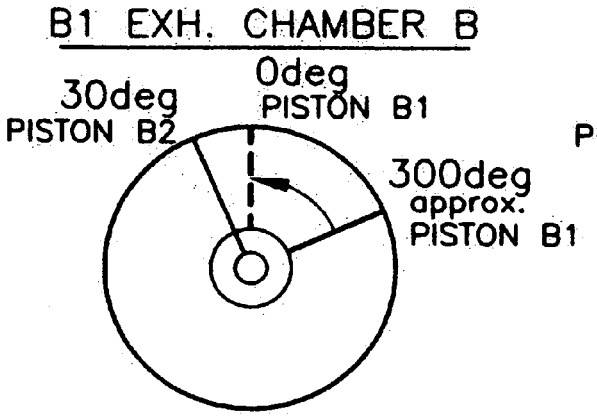
FIG. 4B
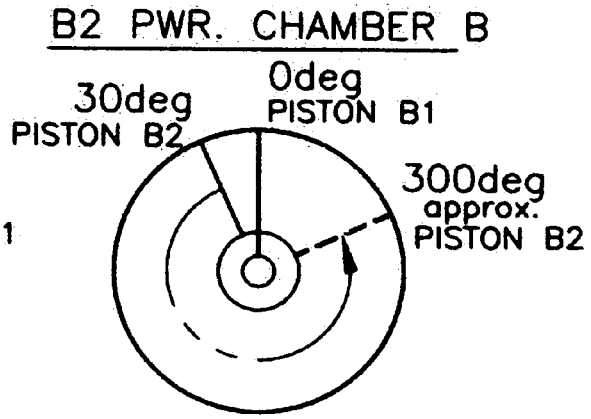
FIG. 5B

FIG. 6A
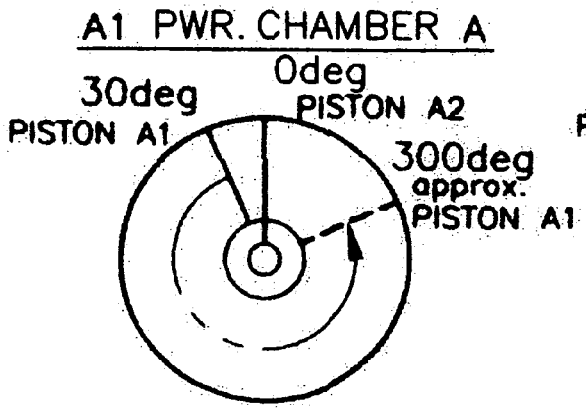
FIG. 7A
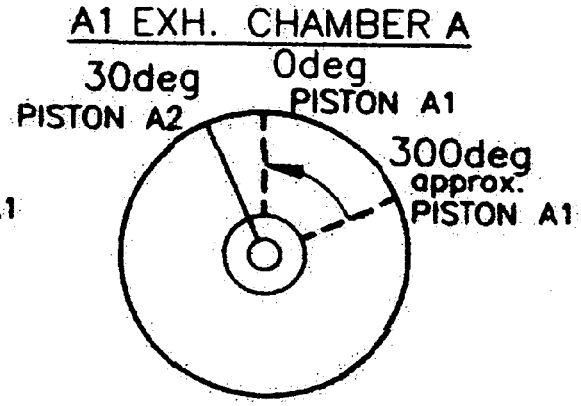
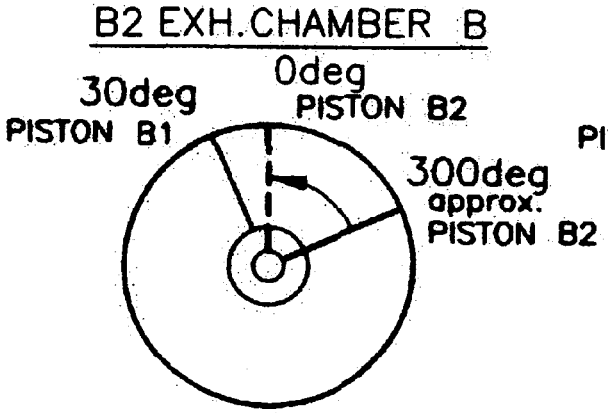
FIG. 6B
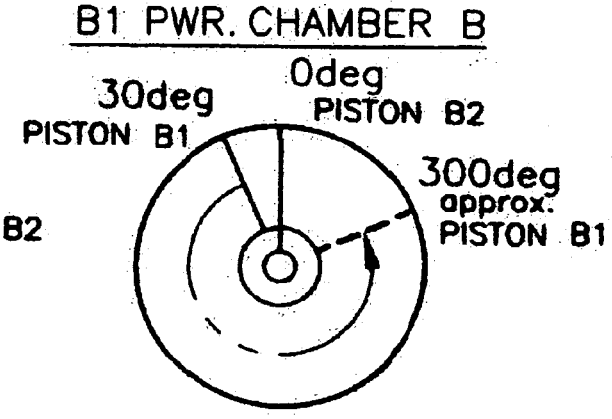
FIG. 7B

| This depicts one of several sequence series | | | | | | |
|---|---|---|---|---|---|---|
| Operation Sequence Number | Radial Distance Moved. Degrees | Operating Sequence Title | Tandem A Engine. Piston Plate Radial Movement. Start–End. Degrees. | Tandem B Engine. Piston Plate Radial Movement. Start–End. Degrees. | Operating Sequence Title | Radial Distance Moved. Degrees |
| 1 | 0 | **A2 injections** | 30 A2/0 A1 | None | None | 0 |
| 2 | 90 | A2 power | 30–120 A2 | 180–270 B1 | B1 power | 90 |
| 3 | 90 | A2 power | 120–210 A2 | 270–360 B1 as B2 moves from 0/360 to 30 | B1 exhaust/ compression | 90 |
| 4 | 0 | None | None | 30 B2/0 B1 | **B2 injections** | 0 |
| 5 | 90 | A2 power/ exhaust | 210–300 A2 | 30–120 B2 | **B2 power** | 90 |
| 6 | 60 | A2 exhaust/ compression | 300–360 A2 as A1 moves from 0/360 to 30 | 120–180 B2 | **B2 power** | 60 |
| 7 | 0 | **A1 injections** | 30 A1/0 A2 | None | None | 0 |
| 8 | 90 | A1 power | 30–120 A1 | 180–270 B2 | B2 power | 90 |
| 9 | 90 | A1 power | 120–210 A1 | 270–360 B2 as B1 moves from 0/360 to 30 | B2 exhaust/ compression | 90 |
| 10 | 0 | None | None | 30 B1/0 B2 | **B1 injections** | 0 |
| 11 | 90 | A1 power | 210–300 A1 | 30–120 B1 | B1 power | 90 |
| 12 | 60 | A1 exhaust/ compression | 300–360 B1 as A2 moves from 0/360 to 30 | 120–180 B1 | B1 power | 60 |
| 13 Repeat at 1 | 0 | **A2 injections** | 30 A2/0 A1 | None | None | 0 |

FIG. 7C

NOTE 1: THERE ARE SEVERAL SENSORS AS LISTED BELOW:

POSITION
PRESSURE(2)-ZERODEGREES AND 10 DEEGREES
TEMPERATURE (x)
TORQUE DISTRIBUTION

| Items/purpose | Device. Signal to CPU | Relationship | Sensor locations |
|---|---|---|---|
| B2A1 piston plates | Piston sensors. Locations are 270deg, 355.4deg, 36.7deg. (B2 power cycle is 36.7deg to 270deg & assists A1) | Piston plate position and clutch actuation sequence | Piston plate A1 position at 270 deg (exhaust cycle start) – clutch engage. Piston plate position at / past 355.4deg (combustion chamber) – clutch disengage |
| A2B1 piston plates | Piston sensors. Locations are 270deg, 355.4deg, 36.7deg. (A2 power cycle is 36.7deg to 270deg & assists B1) | Piston plate position and clutch actuation sequence | Piston plate B! position at 270 deg (exhaust cycle start) – clutch engage. Piston plate position at / past 355.4deg (combustion chamber) – clutch disengage |
| B1A2 piston plates | Piston sensors. Locations are 270deg, 355.4deg, 36.7deg. (B1 power cycle is 36.7deg to 270deg &asssists A2) | Piston plate position and clutch actuation sequence | Piston plate A2 position at 270 deg (exhaust cycle start) – clutch engage. Piston plate position at / past 355.4deg (combustion chamber) – clutch disengage |
| A1B2 piston plates | Piston sensors. Locations are 270deg, 355.4deg, 36.7deg (A1 power cycle is 36.7deg to 270deg & assists B2) | Piston plate position and clutch actuation sequence | Piston plate B2 position at 270 deg (exhaust cycle start) – clutch engage. Piston plate position at / past 355.4deg (combustion chamber) – clutch disengage |

FIG. 10A

| Items/purpose | Device. Signal to CPU | Relationship | Sensor locations |
|---|---|---|---|
| All piston plates | Position sensor | 0deg (detect piston plate position) | Flash chamber. At 0deg–yes then ignition sequences |
| All piston plates | Position sensor | 30deg (detect piston plate position) | Flash chamber. At 30deg–yes then ignition sequences |
| Combustion chamber actuator rod ("diameter.) | Position sensor | Open. Closed after piston plate is centered at 0deg | 348.12deg location of actuator center line |
| Combustion chamber actuator rod ("diameter.) | Position sensor | Open. Closed after piston plate is centered at 30deg | 36.13deg location of actuator center line |
| Ignition timing | Torque based sensor | Advance / Retard | Drive shaft OD. Qty 4. An ignition sequence. |
| Injection timing | Torque based sensor | Advance / Retard | Drive shaft OD. Qty 4. An ignition sequence. |
| Fuel volume | Torque based sensor | Advance / Retard | Drive shaft OD. Qty 4. An ignition sequence. |
| H2O misting system | Torque based sensor | Increase / decrease H2O volume. | Drive shaft OD. Qty 4. An ignition sequence. |
| Hydrogen direct injector | Temperature sensor | Monitor. High limit–shut down | 0deg Injector. 30deg injector. Qty 4. |
| Flash | Temperature sensor | Monitor. High limit–shut down | 15deg |
| Flash | Temperature sensor | Monitor. High limit–shut down | 165deg |
| End of exhaust cycle | Temperature sensor | Monitor. High limit–shut down | 315deg |
| H2O heat transfer system | Temperature sensor | Monitor. Signal to adjust H2O spray volume. 3 nozzles per engine | 1 sensor inside each piston plate periphery. Qty 4 for twin engines. (area of ribbon seal) |

FIG. 10B

| Items/purpose | Device. Signal to CPU | Relationship | Sensor locations |
|---|---|---|---|
| H2O heat transfer system. 12V compressor | Electric power | Monitor yes / no | Line meter |
| Piston plates shafts internal interface areas | Temperature sensor | Monitor only | Attach. TBD. Qty. 1 |
| Piston plates shafts internal interface areas | Pressure sensor (OEM bearing seal) | Monitor only | Attach. TBD. Qty. 1 (synthetic lubrication) |
| Hydrogen fuel supply system | Hydrogen leak sensor | Monitor. Close fuel valve. | Hydrogen supply line. Qty 1 |
| Air injection manifold | Pressure sensor | Monitor | Qty 4 manifolds per engine |
| Air injection manifold 12V compressor | Electric power | Monitor yes / no | Line meter |
| Hydrogen fuel | Line pressure sensor | Monitor | Distribution manifold |
| Hydrogen hydride tank (low pressure) US 5,778,972 | Fuel level sensor | Monitor and software | Estimate remaining miles / estimate remaining time |
| Hydrogen hydride system. 12V compressor | Electric power | Monitor yes / no | Line meter |
| High pressure tank | Fuel level sensor | Monitor and software | Estimate remaining miles / estimate remaining time |

FIG. 10C

ROTARY ENGINE SYSTEM

RELATED APPLICATIONS

This application claims an invention that was disclosed in U.S. Provisional Application No. 60/476,975, filed 9 Jun. 2003, entitled "Rotary Engine System". The benefit under 35 USC §119(e) and/or other applicable law of the aforesaid United States provisional application is hereby claimed, and the aforementioned application is hereby incorporated herein by reference.

TECHNICAL FIELD

The present invention relates to internal combustion engines, and more specifically, to non-turbine rotary engines having a non-eccentric configuration.

BACKGROUND

Internal combustion engines having a rotary configuration can generally be classified as turbine or non-turbine. In turbine engines, a flow of combustion gases parallel to an axle impacts inclined vanes attached to the axle, causing the axle to rotate. This rotational motion is then used to perform work. This type of rotary internal combustion engine is widely accepted and used.

The field of non-turbine rotary engines has seen far less development and practical application. In this field, only eccentric rotary engines, such as the Wankel engine, have been significantly developed and used. Non-turbine rotary engines that are also non-eccentric have been proposed in numerous patents, but have not seen significant development and use to this date. Representative examples of engines of this general type can be seen in the following U.S. Patents:

U.S. Pat. No. 1,458,641 issued to Cizek in 1923 for a "Rotary Internal-Combustion Engine."

U.S. Pat. No. 1,482,627 issued to Bullington in 1924 for a "Rotary Internal Combustion Engine."

U.S. Pat. No. 2,816,527 issued to Palazzo in 1957 for a "Rotary Four-Stroke Engine."

U.S. Pat. No. 2,944,533 issued to Park in 1960 for an "Internal Combustion Engine."

U.S. Pat. No. 3,227,090 issued to Bartolozzi in 1966 for a "Engine or Pump Having Rotors Defining Chambers of Variable Volumes."

U.S. Pat. No. 3,595 issued to McMaster in 1971 for "Rotary Engines."

U.S. Pat. No. 3,712,273 issued to Thomas in 1973 for an "Internal Combustion Rotary Engine."

U.S. Pat. No. 3,857,370 issued to Hemenway in 1974 for a "Rotary Internal Combustion Engine."

U.S. Pat. No. 3,885,532 issued to Pike in 1975 for a "Rotary Engine."

U.S. Pat. No. 3,918,414 issued to Hughes in 1975 for a "Rotary Motor."

U.S. Pat. No. 4,136,661 issued to Posson in 1979 for a "Rotary Engine."

U.S. Pat. No. 4,148,292 issued to Reyblatt in 1979 for a "Energy Conversion Devices."

U.S. Pat. No. 4,239,465 issued to Guillaume in 1980 for a "Rotary Motor with Alternating Pistons."

U.S. Pat. No. 4,279,577 issued to Appleton in 1981 for a "Alternating Piston Rotary Engine with Latching Control Mechanism and Lost Motion Connection."

U.S. Pat. No. 4,319,551 issued to Rubinshtein in 1982 for a "Rotary Internal Combustion Engine."

U.S. Pat. No. 4,646,694 issued to Fawcett in 1987 for a "Rotary Engine."

U.S. Pat. No. 5,192,201 issued to Beben in 1993 for a "Rotary Engine and Drive Coupling."

U.S. Pat. No. 5,685,269 issued to Wittry in 1997 for a "High Speed Rotary Engine and Ignition System."

However, none of these devices provides the simplicity, efficiency, ease of operation and advantages of my invention.

SUMMARY OF THE INVENTION

The rotary internal combustion engine of my invention overcomes many of the problems and defects of prior art devices in a design that is simple, durable, and easily implemented. In its most basic embodiments it is comprised of two rotatable vane type pistons mounted for axial rotation in a sealed casing. Engageable locking mechanisms can lock the two pistons in position proximate to each other so as to form a combustion space between the two pistons. One piston is released to rotate at or prior to initiating combustion in the combustion space, while the other remains fixed.

As the free piston rotates around to the position where the first piston is located, it drives exhaust from a prior cycle out of an exhaust outlet and then compresses air towards the combustion space. The force of these compressed gases can serve to move the formerly fixed piston to the starting position for the moving piston as the moving piston takes the position formerly held by the fixed piston. However, in the preferred embodiments of my invention, two units are operated in tandem. In this situation, the power stroke of one unit provides power to help finalize the cycle of the other unit and rotate the moving piston all the way to the fixed piston position. In either case, the roles of the pistons are reversed on the next cycle with the piston that was fixed before becoming the moving piston and the piston that was moving before becoming the fixed piston.

In the preferred embodiments my engine is operated using Hydrogen for fuel and thereby generates water vapor (steam) as a combustion byproduct. Water is also introduced into the combustion chamber as an entrained mist or spray so as to generate additional steam to enhance the operation of the system and to lubricate its working parts. Thus the primary byproduct of my invention—steam—is not only non-polluting in itself, it can and is intended to serve as a piston/combustion chamber lubricant for my invention. Thus, in its preferred embodiments my invention serves to largely eliminate piston/combustion chamber lubricants as well as exhaust as sources of environmental pollution. However, it is also capable of being used with more typical fuels and lubricants if desired.

DRAWINGS

FIG. 1A provides a first schematic side view of my invention, illustrating its casing and two radial vanes/pistons in locked position at the initiation of a power stroke.

Figure 1B:
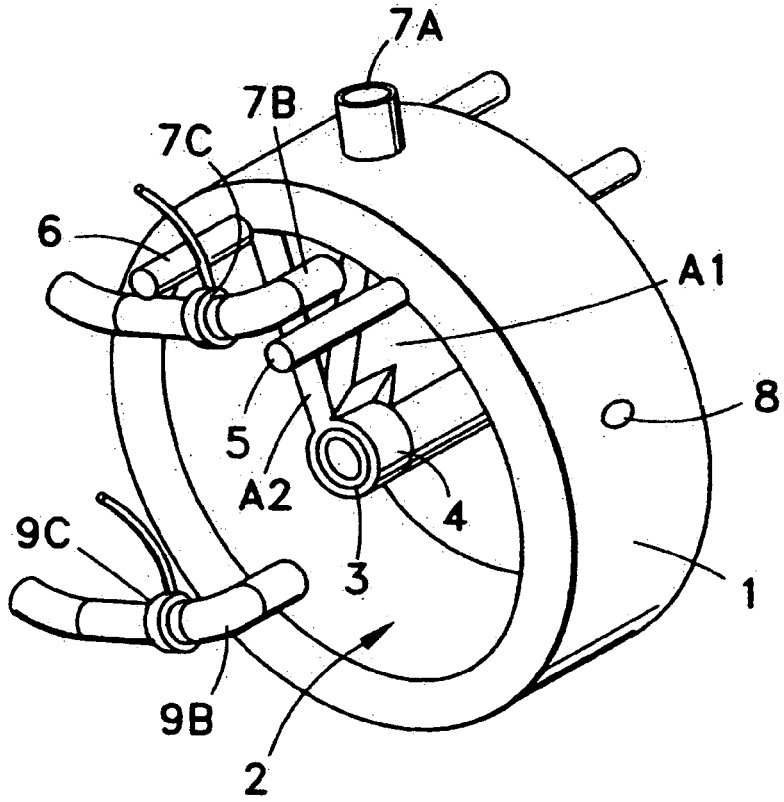

FIG. 1B provides a first schematic perspective view of my invention. Like FIG. 1A, it illustrates the casing and two radial vanes/pistons in locked position at the initiation of a power stroke.

Figure 1C:
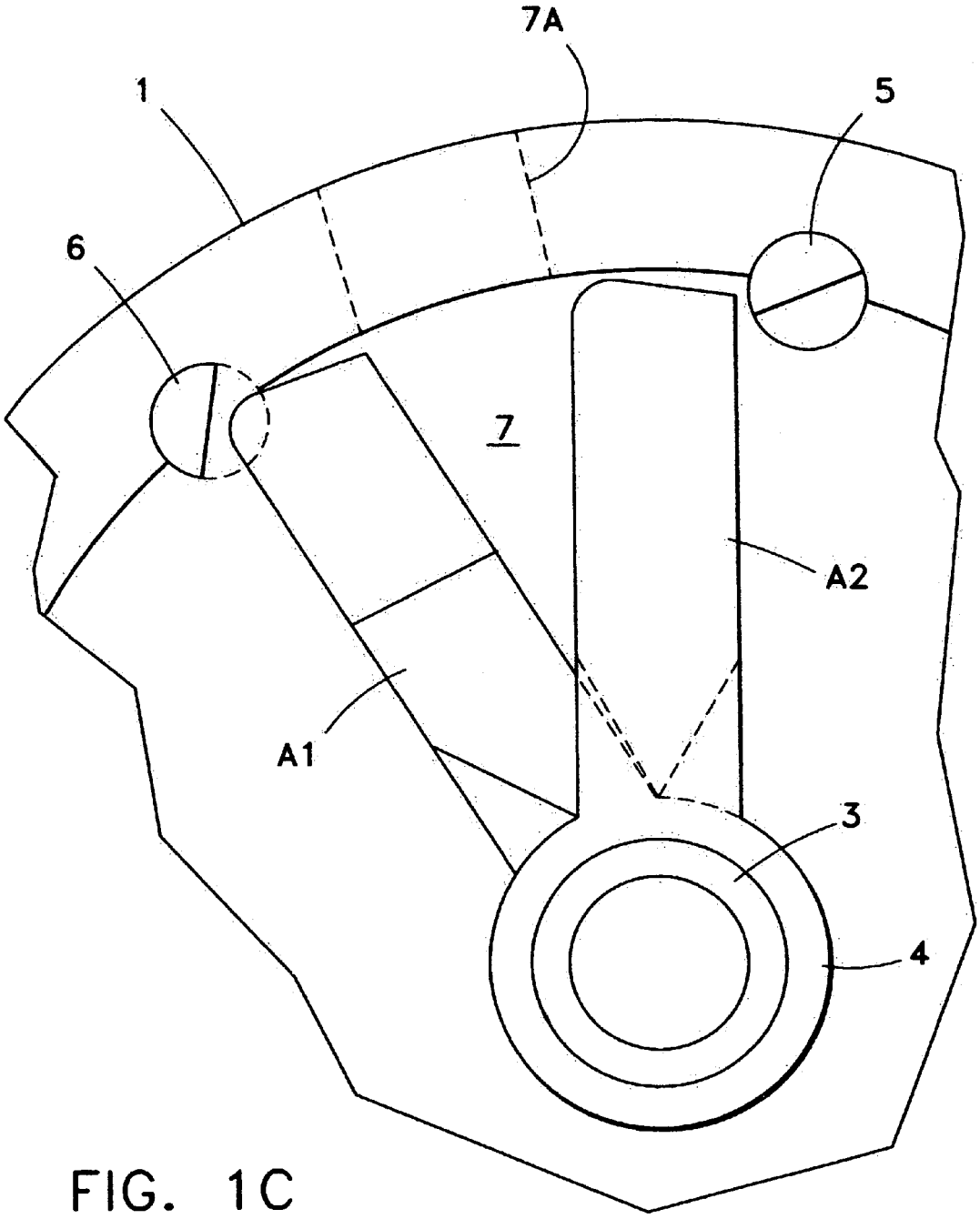

FIG. 1C provides a more detailed side schematic of the top portion of the combustion chamber of my invention, illustrating the shape of its engageable locking mechanisms.

Figure 2A:
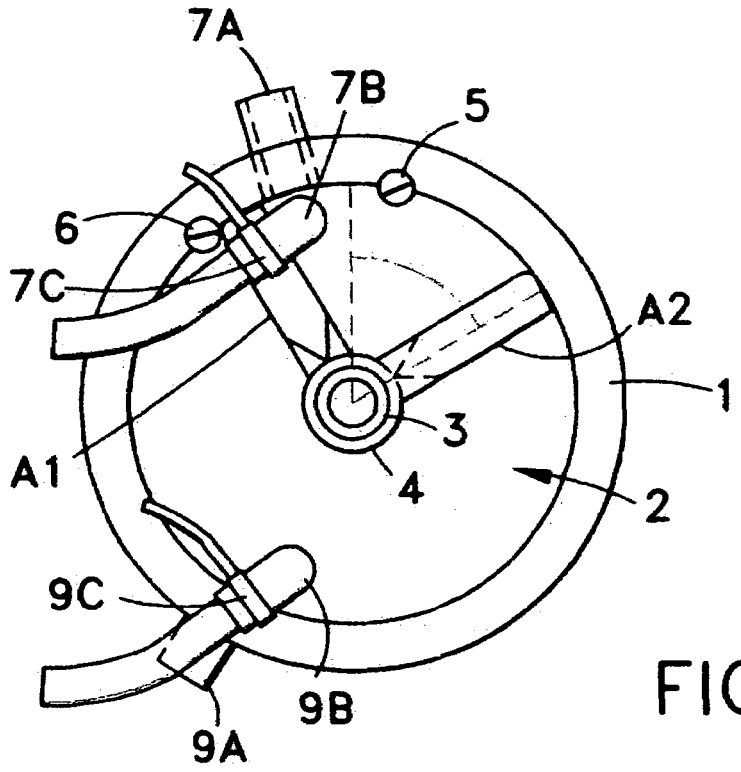

FIG. 2A provides a second schematic side view of my invention, illustrating its two vanes/pistons at a later point in time where the stationary piston remains in its starting position and the rotating piston has moved more than half way around towards its starting position.

Figure 2B:
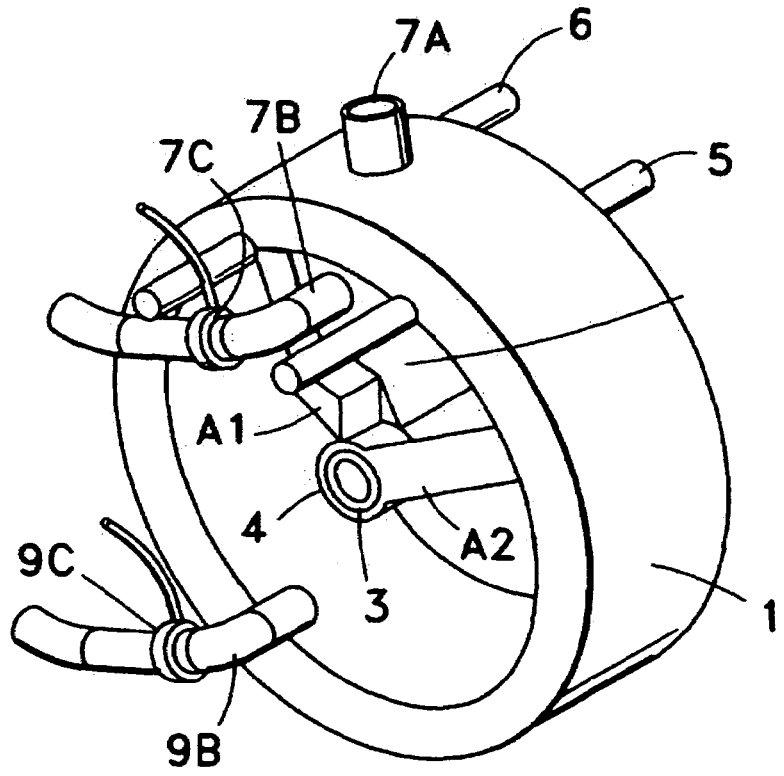

FIG. 2B provides a second schematic perspective view of my invention. Like FIG. 2A, it illustrates the two vanes/pistons at a later point in time where the stationary piston remains in its starting position and the rotating piston has moved more than half way around towards its starting position.

Figure 3A:
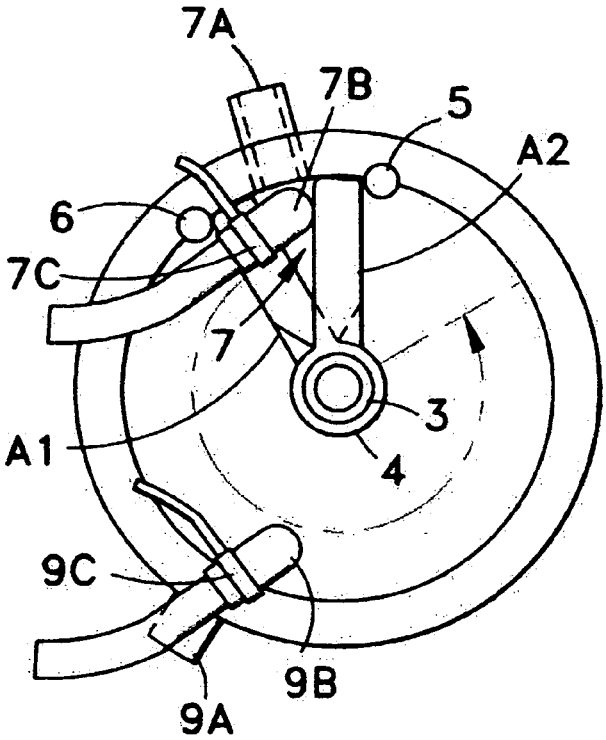

FIG. 3A provides a third schematic side view of my invention, illustrating its two vanes/pistons at a still later point in time where the stationary piston has moved from its starting position into position to be the rotating piston on the next cycle and the rotating piston has moved to the stationary piston position so as to be positioned to act as stationary piston on the next cycle.

Figure 3B:
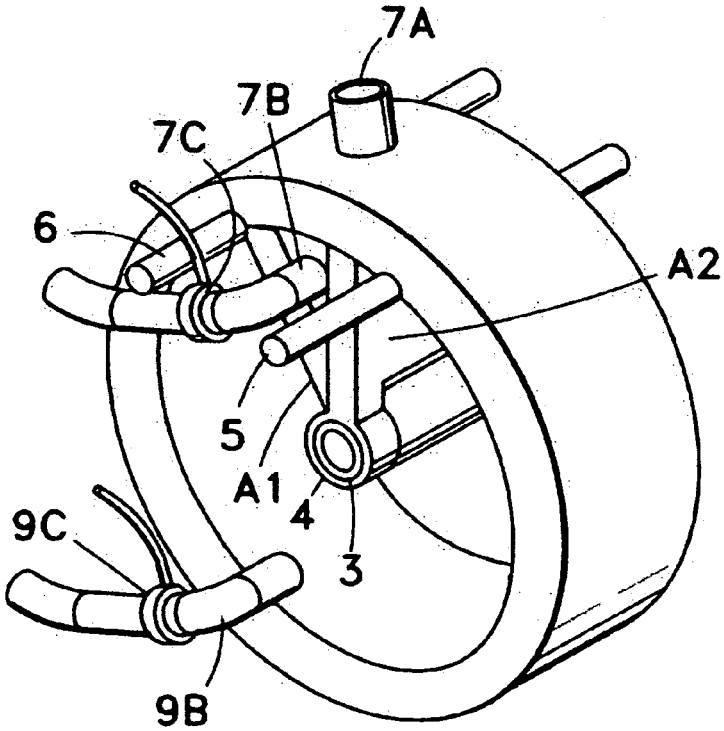

FIG. 3B provides a third schematic perspective view of my invention. Like FIG. 3A, it illustrates the two vanes/pistons at a still later point in time where the stationary piston has moved from its starting position into position to be the rotating piston on the next cycle and the rotating piston has moved to the stationary piston position so as to be positioned to act as stationary piston on the next cycle.

Figure 3C:
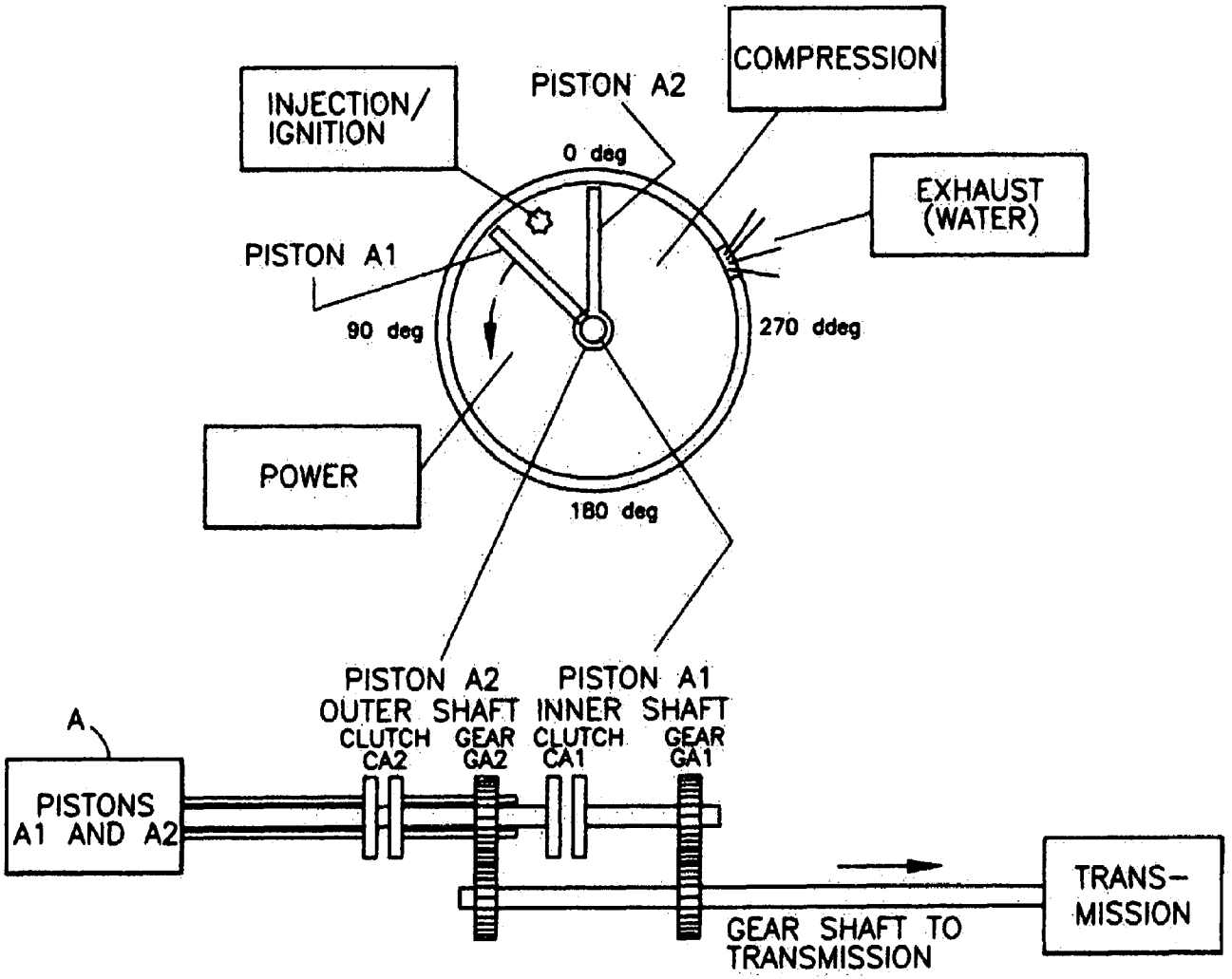

FIG. 3C provides a schematic view of a combustion chamber of my invention operating in conjunction with a clutch and gear system as part of a power train.

FIG. 4A provides a schematic view of combustion in a chamber A (which has pistons A1, A2) driving piston A2 from its second position. In this initial combustion phase, piston A2 is linked to piston B1 in chamber B illustrated in FIG. 4B.

FIG. 4B provides a schematic view of a chamber B (which has pistons B1, B2) linked to chamber A such that the power phase of chamber A, for piston A2 is used to move piston B1 through to the completion of its cycle to first position in chamber B.

FIG. 5A provides a schematic view of chamber A where piston B2 of chamber B (in its initial combustion phase) is being used to assist piston A2 of chamber A.

FIG. 5B provides a schematic view of chamber B where piston B2 of chamber B (in its initial combustion phase) is being used to assist piston A2 of chamber A.

FIG. 6A provides a schematic view of chamber A where piston A1 of chamber A (in its initial combustion phase) is being used to assist piston B2 of chamber B.

FIG. 6B provides a schematic view of chamber B where piston A1 of chamber A (in its initial combustion phase) is being used to assist piston B2 of chamber B.

FIG. 7A provides a schematic view of chamber A where piston B1 of chamber B (in its initial combustion phase) is being used to assist piston A1 of chamber A.

FIG. 7B provides a schematic view of chamber B where piston B1 of chamber B (in its initial combustion phase) is being used to assist piston A1 of chamber A.

FIG. 7C provides a more complete schematic chart showing operational details related to the functioning of two combustion chambers in tandem.

Figure 8:
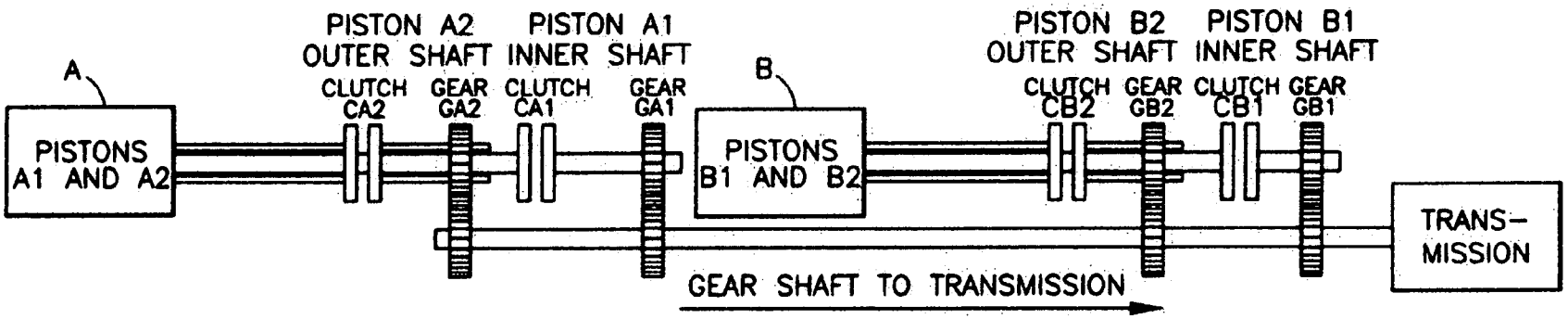

FIG. 8 provides a schematic view of a clutch and gear arrangement for use with my invention, the two combustion chambers acting cooperatively such that each combustion chamber serves during its power stroke to help move necessary elements of the other chamber to required positions for a next power stroke in that other chamber.

Figure 9A:
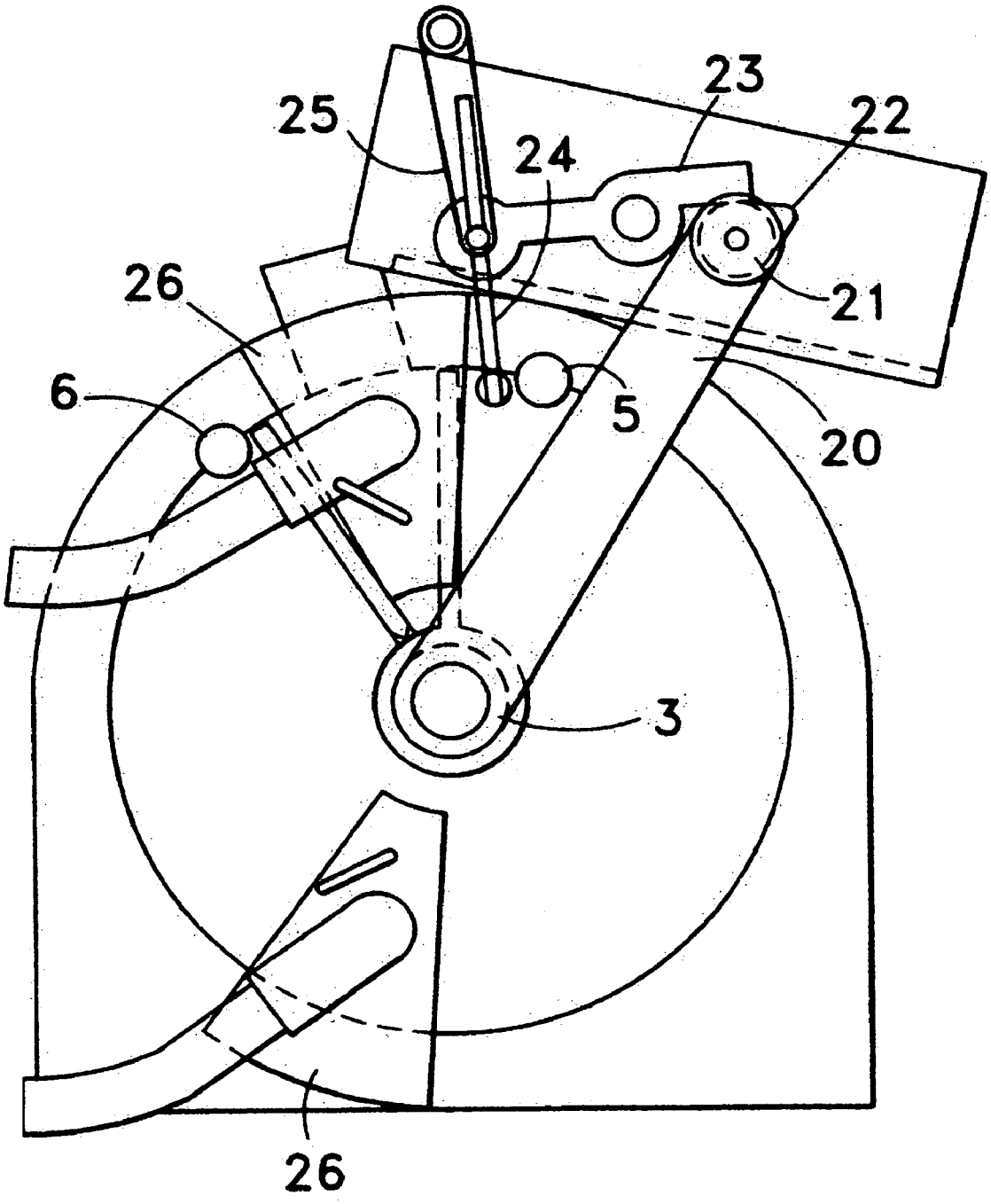

FIG. 9A provides a schematic side view of a chamber of my invention, illustrating a mechanical timing chain arrangement to operate a locking mechanism of the invention. This mechanism can also be used to time the engagement of clutches and gears related to the operation of the invention.

Figure 9B:
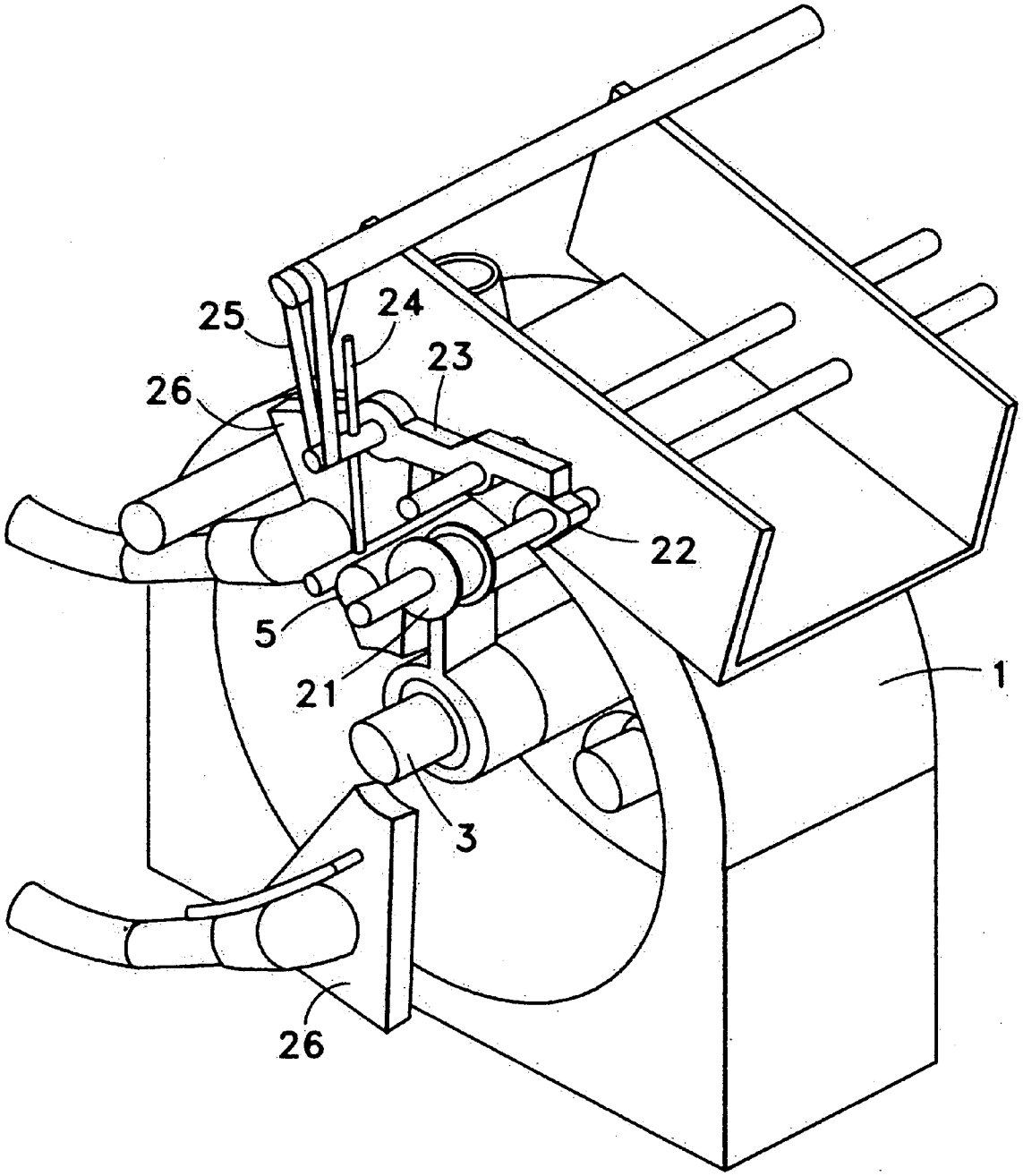

FIG. 9B provides a schematic perspective view based on FIG. 9A.

Figure 9C:
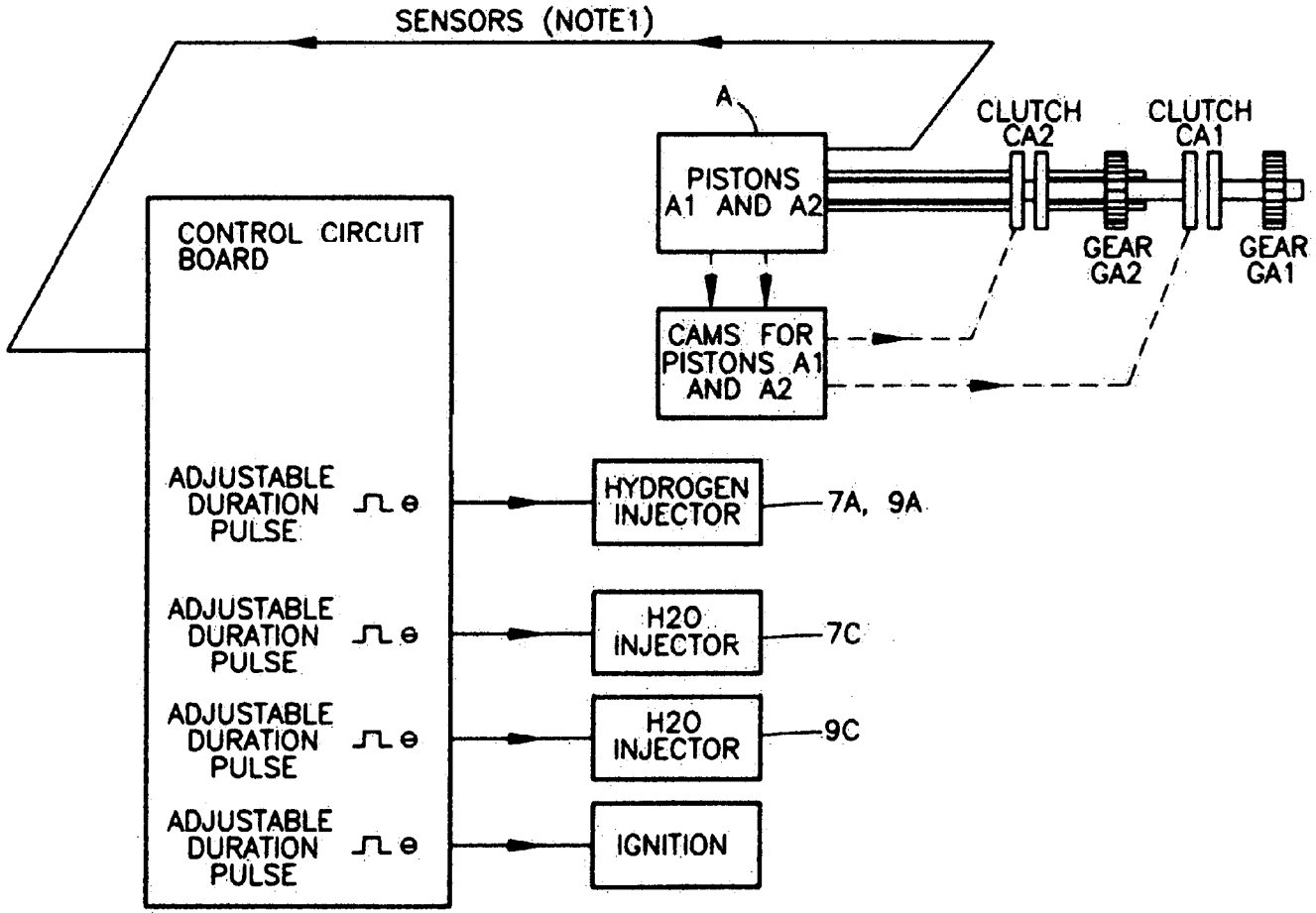

FIG. 9C provides a schematic view of a combustion chamber of my invention operating in conjunction with a clutch and gear system as part of a power train and an electronic monitoring and control system.

FIG. 10A provides a first schematic chart showing preferred types and positionings of sensors and their relationship to the overall operation of the control system of my invention.

FIG. 10B provides a second schematic chart showing preferred types and positionings of sensors and their relationship to the overall operation of the control system of my invention.

FIG. 10C provides a third schematic chart showing preferred types and positionings of sensors and their relationship to the overall operation of the control system of my invention.

DETAILED DESCRIPTION

An initial understanding of the structure and operation of my invention can best be obtained by review of the basic schematics illustrated in FIGS. 1A through 3C. As will be noted upon review of these figures, my invention is relatively simple in overall design. Its combustion chamber is formed by a casing 1 defining a closed internal plenum (denoted generally by arrow 2). A rotatable shaft 3 with a first radial piston A1 attached extends through plenum 2. A rotatable sleeve 4 on shaft 3 with a second radial piston A2 attached also extends through plenum 2 such that said first radial piston A1 and said second radial piston A2 define two substantially closed spaces within plenum 2. (An engine bearing system for my invention can include radial and axial load carrying sealed bearings with synthetic lubricant and/or ceramic bearings, and thrust bushings). A first engageable locking mechanism 5 serves to prevent rotary movement of a radial piston A1, A2. (The position of a radial piston A1, A2 when engaged by said first locking mechanism 5 will be hereafter referred to as the first position). A second engageable locking mechanism 6 likewise prevents rotary movement of a radial piston A1, A2. (The position of a radial piston A1, A2 when locked by said second locking mechanism will be hereafter referred to as the second position).

The substantially closed space between radial pistons A1, A2 when one of said radial pistons A1, A2 is in the first position and the other radial piston A2, A1 is in the second position serves as an initial combustion space (denoted generally by arrow 7 in FIG. 1A). As will be noted in reviewing the drawings of the preferred embodiment, the first locking mechanism 5 (when engaged) merely needs to prevent a piston A1, A2 from moving away from the initial combustion space 7. Locking mechanism 5 does not need to prevent it from moving into the initial combustion space 7 when engaged. Likewise, the second locking mechanism 6 prevents a piston A1, A2 from moving away from initial combustion space 7 when engaged, but does not prevent it from moving into the initial combustion space 7. Locking mechanisms 5,6 can be advantageously formed by cylindrical members with flattened portions (i.e.—removed semi-cylindrical sections) within casing 1 and generally adjacent plenum 2, such that a slight rotation will release a radial piston A1, A2. (See, FIG. 1C). A preferred apparatus or means for operating these locking mechanisms is described in more detail in the discussion of FIGS. 9A and 9B, below.

In the preferred embodiments illustrated, fuel and oxidizer are introduced into initial combustion space 7 by, respectively, a fuel insertion inlet 7A and a separate oxidizer insertion inlet 7B. (However, these two could be combined with a single opening serving as both fuel insertion inlet 7A and oxidizer inlet 7B). Combusting the fuel and oxidizer mixture introduced in the initial combustion space 7 drives a radial piston A1, A2 from the second position towards the first position as illustrated in FIGS. 1A through 3C. (Combustion can be initiated by a simple spark mechanism which can be positioned on, e.g., casing 1 or radial pistons A1,A2). The second engageable locking mechanism 6 is disengaged at or prior to combusting said fuel and oxidizer mixture, but the first engageable locking mechanism 5 remains engaged during the process. As a radial piston A1, A2 moves from the second position to the first position, it expels exhaust from a prior combustion through at least one exhaust outlet 8. After passing the exhaust outlet 8 the radial piston A1,A2 compresses the oxidizer (usually ambient air) received via oxidizer insertion inlet 7B towards initial combustion space 7. In addition, as illustrated in the drawing figures, this basic combustion cycle can be supplemented by a second combustion at a later point in the cycle. This can be readily accomplished by the positioning of a second fuel insertion inlet 9A and a second oxidizer insertion inlet 9B between the second position and exhaust outlet 8. Combustion can, once again, be initiated using means well known in the mechanical arts via a spark from radial pistons A1, A2 or casing 1.

Although my invention, as previously outlined, can operate purely on the combustion of fuel and oxidizer, its operation is greatly enhanced by the introduction of clean water as vapor or spray during the combustion process. This can assist in the lubrication process. However, more importantly, it assists in converting the extreme heat generated by the combustion of my preferred fuel, hydrogen, into a more utilizable form. Water absorbs the heat of hydrogen combustion, flashing into steam and lowering the temperature of the combustion chamber substantially in the process. The pressure generated by the high volume of steam generated in this process is the primary source of force for driving the radial pistons A1, A2 of my invention. Further, as exhaust, this steam also provides a very useful byproduct for, e.g., home or business heating purposes or for power generation. Water used for this purpose can be advantageously entrained in the air/oxidizer stream for the system via atomizer spray nozzles 7C, 9C. Alternatively, water can be injected at various other points through the casing. In whatever manner it is produced, and however it is initially used after it is exhausted from a combustion chamber, the steam produced and used by my invention can easily be run though a condensation system and then reintroduced (recycled) as water for further use in my invention.

The torque and power generated by a single chamber of my invention can be advantageously harnessed using a clutch and gear system of the type schematically illustrated in FIG. 3C. In operation, clutch CA2 is engaged while radial piston A2 is reacting to combustion (prior to reaching exhaust outlet 8) and conveys torque via gear GA2 to a power train. During this same period, radial piston A1 is engaged at the first position via locking mechanism 5. Thus, clutch CA1 is disengaged, breaking the connection between radial piston A1 and gear GA1. However, as soon as the next cycle begins, the positions and actions of the aforesaid elements are reversed.

The aforesaid system can be used alone or in conjunction with a flywheel or system equivalent to maintain a steady stream of power/torque and facilitate the operation of my invention. However, it is more advantageous to operate at least two of my combustion chambers in tandem, so that the combustion phase of one assists the other in completing its cycle. Oxidizer compressed by radial piston A1, A2 while being driven from the second position to the first position and/or introduced via oxidizer inlet 7B serves to push the other radial piston A1, A2 from the first position to the second position. (See, FIGS. 2A through 3B). Unfortunately, at this point, the compressed air between piston A1 and piston A2 may serve to force them apart, preventing the next piston A1, A2 in line from being able to reach the first position. This problem is compounded by the fact that the exhaust from combustion has been allowed to escape via outlet S. Thus, there is no longer any countervailing force in operation. When at least two combustion chambers are operated in tandem, the power stroke of one chamber can be used to facilitate completion of the cycle in the other.

The general operations of multi-chamber systems can be illustrated using only two chambers A, B operating in tandem. (See, FIGS. 4A through 7B). Obviously, in this situation, each chamber A, B initiates combustion of fuel at a different time such that one chamber engine, the "later" chamber, is initiating combustion in its initial combustion space 7 after the other chamber, the "earlier" chamber, has already initiated combustion in its initial combustion space 7. Thus, when the earlier chamber has largely exhausted the energy available from combustion (its moving radial piston may even have passed exhaustion outlet 8 and begun releasing combustion byproducts), the later chamber will have just initiated combustion in its initial combustion space or, at the least, will be earlier in its combustion cycle. In this situation, the excess power available from the later chamber can be used to help finish the cycle of the earlier chamber by assisting in driving the moving radial piston of the earlier chamber the remainder of the distance to the first position.

The best understanding of this system can, once again, be gained from first reviewing simplified schematics illustrating two chambers A, B operating in tandem as shown in FIGS. 4A through 7B:

1. In FIG. 4A combustion is initiated in chamber A (which has pistons A1, A2) driving piston A2 from second position. In this initial combustion phase, piston A2 is linked to piston B1 in chamber B. (See, FIG. 4B). Thus, the power phase of chamber 1, for piston A2 is used to move piston B1 through to the completion of its cycle to first position in chamber B.
2. In FIGS. 5A and 5B, the situation is reversed, with piston B2 (in its initial combustion phase) being used to assist piston A2 in moving to first position.
3. In FIGS. 6A and 6B, the cycle illustrated above continues, with piston A1 of chamber A in its initial combustion phase serving to assist piston B2 of chamber B.
4. In FIGS. 7A and 7B, the tandem system returns to its initial configuration, ready for the beginning of another cycle, with piston B1 in its combustion phase assisting piston A1 back to first position.

The foregoing information and system review provides a basis for understanding the more detailed schematic chart presented in FIG. 7C.

The torque and power generated by two combustion chambers A, B operating in tandem can be advantageously harnessed using a clutch and gear system of the type schematically illustrated in FIG. 8. Here, as in FIG. 3C, a respective clutch CA1, CA2 and gear GA1, GA2 is engaged while its respective radial piston A1, A2 is reacting to combustion and conveys torque to a power train. During the period that a radial piston A1, A2 is engaged at the first position via locking mechanism 5, its respective clutch CA1, CA2 is disengaged, breaking the connection between radial piston A1, A2 and its respective gear GA1, GA2. However, in this case, as discussed with reference to FIGS. 4A through 7C, a second chamber B is also operating in the same general manner. And, a radial piston B1, B2 of the second chamber B will also be connected via its respective clutch CB1, CB2 and gear GB1, GB2 to the power train during at least part of the time that A1, A2 is connected thereto. This connection serves to assist in moving the radial piston A1, A2, B1, B2 of the system that is nearing the end of its cycle back to the first position in its respective chamber A, B. For this purpose, I have found it advantageous to intiate combustion in a chamber A, B when the radial piston of the other chamber A, B that has just experienced combustion has traversed approximately 180 degrees from the second position. This provides support for the "weak" part of the cycle in each chamber A, B and assures smooth and effective operation.

Coordinating the activities of single chamber or even of two chambers operating in tandem can be accomplished by mechanical linkages of the type well known in the mechanical arts for use with engines and mechanical systems. They can also be accomplished via electronic monitoring and operational systems of the type currently known and practiced with regard to engines and mechanical systems. However, I have found it advantageous to combine these approaches by coordinating mechanical linkages with an electronic monitoring and operational system. Thus, FIGS. 9A and 9B provide schematic views of a chamber of my invention, illustrating a mechanical timing chain arrangement to operate locking mechanism 5. (This embodiment also features manifolds 26 for introduction of water and air into the combustion chamber). In these drawing figures, a timing chain or belt 20 runs between inner shaft 3 and pulley 21. Pulley 21 is arranged to turn a cam 22 that interacts with a lever arm 23 to operate a link 24 connected to engageable locking mechanism 5 and biased by tensioner 25. There is a 1:1 correspondence between the turning of the shaft 3 and the turning of cam 22 with the system being arranged to disengage locking mechanism 5 so as to allow radial piston A1 to pass and be locked into the first position at an appropriate point in its cycle. (Similar mechanisms can be used to time and effectuate the engagement/disengagement of other elements, clutches and gears related to the operation of the invention). Arrangements of this type can advantageously be coupled with an electronic monitoring and control system of the type illustrated schematically in FIG. 9C. Further details regarding the type and positioning of sensors and the overall operation of my control system are provided by the charts of FIGS. 10A-10C, which describe the sensor devices and their functions and locations.

However, numerous changes and variations can be made to the system without exceeding the scope of the inventive concept. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

I claim:

1. A method for operating rotary internal combustion engine systems, comprising:

providing two independent rotary internal combustion engines having power trains and linking apparatus for linking said power trains, each of said two independent rotary internal combustion engines further comprising:

a casing defining an internal plenum;

a rotatable shaft extending through said plenum with a first radial piston permanently attached thereto;

a rotatable sleeve on said shaft with a second radial piston permanently attached thereto such that said first radial piston and said second radial piston define two substantially closed spaces within said plenum;

a first engageable locking mechanism for preventing rotary movement of said first radial piston and said second radial piston, the position of said first radial piston and said second radial piston when engaged by said first locking mechanism being a first position;

a second engageable locking mechanism for preventing rotary movement of said first radial piston and said second radial piston, the position of said first radial piston and said second radial piston when engaged by said second locking mechanism being a second position, a substantially closed space between said first radial piston and said second radial piston when one of said first radial piston and said second radial piston is in the first position and the other of said first radial piston and said second radial piston is in the second position being an initial combustion space;

an exhaust outlet in communication with said plenum;

an oxidizer insertion inlet in communication with said plenum;

a fuel insertion inlet in communication with said plenum;

means for combusting a fuel and oxidizer mixture in said initial combustion space so as to drive one of said first radial piston and said second radial piston from said second position around said shaft towards said second position, said first radial piston and said second radial piston alternating as the driven piston; and wherein at least one of said first engageable locking mechanism and said second engageable locking mechanism engages at least one of said first radial piston and said second radial piston to prevent rotary movement of said radial piston; and initiating combustion of fuel in said two independent rotary internal combustion engines at different times such that one of said two independent rotary internal combustion engines is initiating combustion in its initial combustion space after the other of said two independent rotary internal combustion engines has already initiated combustion in its initial combustion space.

2. The method for operating rotary internal combustion engine systems, as described in claim 1, further comprising initiating combustion of fuel in said two independent rotary internal combustion engines at different times such that one of said two independent rotary internal combustion engines is exhausting byproducts via its exhaust outlet when the other of said two independent rotary internal combustion engines initiates combustion in its initial combustion space.

3. The method for operating rotary internal combustion engine systems, as described in claim 2, further comprising one of said two rotary internal combustion engines assisting the other of said two rotary internal combustion engines in moving the driven piston of the other of said two rotary internal combustion-engines from the second position towards the first position by said linking apparatus linking the drive trains of said engines together so that an engine assists an other engine.

4. The method for operating rotary internal combustion engine systems, as described in claim 1, further comprising one of said two rotary internal combustion engines assisting the other of said two rotary internal combustion engines in moving the driven piston of the other of said two rotary internal combustion-engines from the second position towards the first position by said linking apparatus linking the drive trains of said engines together so that an engine assists an other engine.

* * * * *